United States Patent [19]

Mannbro

[11] 4,155,806

[45] May 22, 1979

[54] METHOD FOR CONTINUOUS ALKALINE DELIGNIFICATION OF LIGNOCELLULOSE MATERIAL IN TWO OR MORE STEPS, THE FINAL OF WHICH WITH OXYGEN

[75] Inventor: Nils V. Mannbro, Asarum, Sweden

[73] Assignee: Skogsagarnas Industri Aktiebolag, Vaxjo, Sweden

[21] Appl. No.: 574,908

[22] Filed: May 6, 1975

[30] Foreign Application Priority Data

May 16, 1974 [SE] Sweden ..... 7406537

[51] Int. Cl.[2] ..... D21C 11/04

[52] U.S. Cl. ..... 162/19; 162/30 K; 162/33; 162/60; 162/62; 162/65

[58] Field of Search ..... 162/17, 19, 62, 30, 162/34, 33, 40, 37, 65, 55, 60, 41, 49

[56] References Cited

U.S. PATENT DOCUMENTS

| | | | |
|---|---|---|---|
| 3,097,987 | 7/1963 | Sloman | 162/17 |
| 3,413,189 | 11/1968 | Backlund | 162/19 |
| 3,679,543 | 7/1972 | Rivers | 162/49 |
| 3,759,783 | 9/1973 | Samuelson et al. | 162/65 |
| 3,830,688 | 8/1974 | Mannbro | 162/65 |
| 3,832,276 | 8/1974 | Roymoullk et al. | 162/65 |

*Primary Examiner*—S. Leon Bashore
*Assistant Examiner*—William F. Smith
*Attorney, Agent, or Firm*—Young & Thompson

[57] ABSTRACT

This invention relates to a process for multi-stage alkaline pulping of ligno-cellulosic raw materials and recovery of delignification spent liquors, i.e. black liquor from digestion with white liquor and oxy-liquor comprising bleach plant effluent extracted from alkaline oxygen delignification of brown stock.

According to the invention, oxy-liquor and intermediate black liquor in the digester are passed through that part of the material column to which the cellulosic raw material, e.g. wood chips, enters. There, hydroxide deriving from two sources, white liquor and oxy-liquor, is exhausted prior to its discharge as terminal black liquor. White liquor is consequently injected to the level of the pre-digested material in the column. This injection is controlled by continuous measurement, e.g. by automated titration analysis, of the hydroxide concentration in the joint volume of oxy-liquor and white liquor in the main cooking liquor circulation system.

By this means the concentration ratio $R$ = oxygen consuming substance/sodium will be favorably low for the cooking liquor residues which accompany the brown stock to the oxy-stage, while the terminal black liquor is enriched on organic oxygen consuming substances, i.e. combustible solids, in relation to the sodium from which hydroxide is to be regenerated.

4 Claims, 1 Drawing Figure

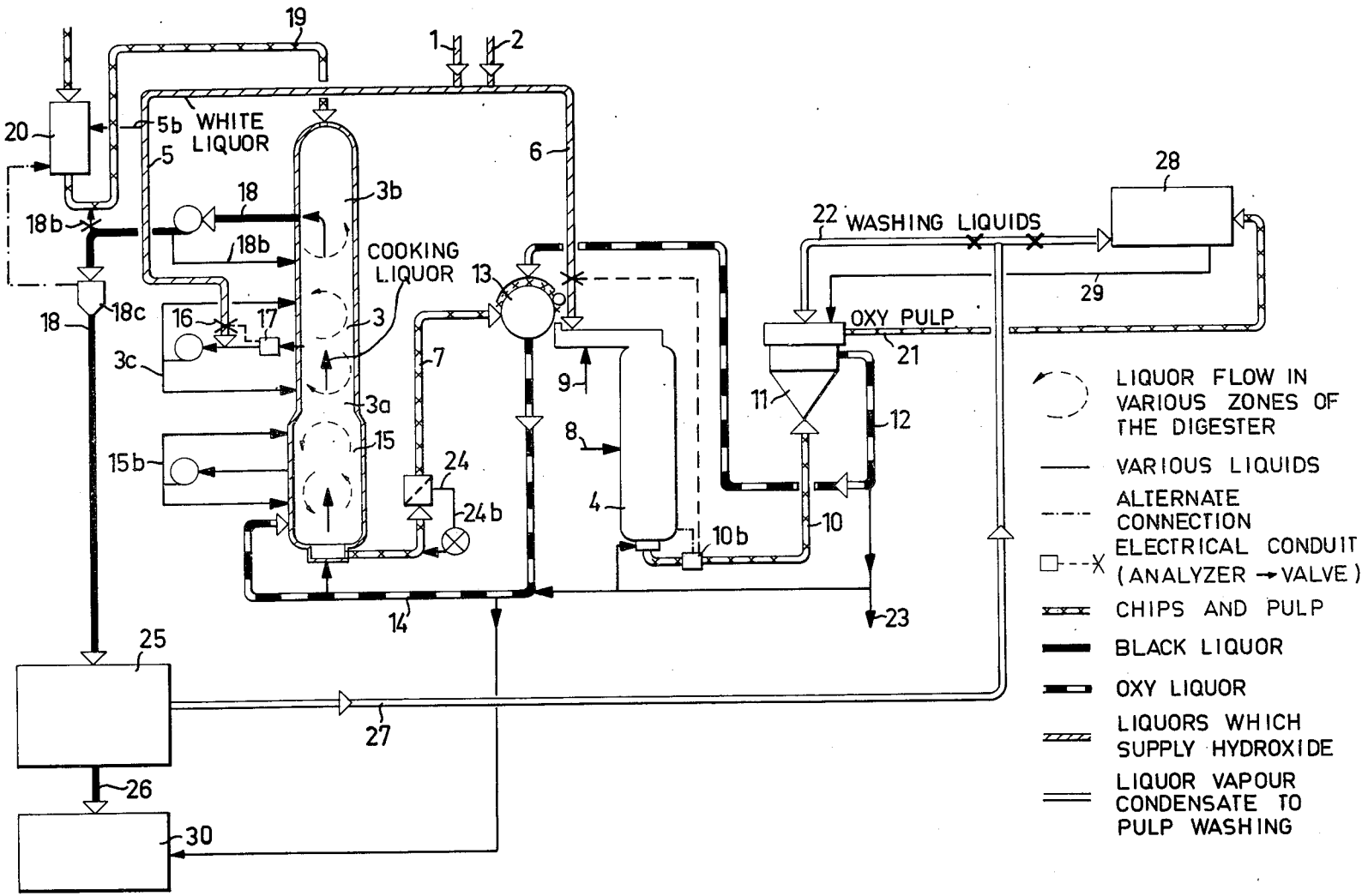
LIQUOR FLOW IN VARIOUS ZONES OF THE DIGESTER
VARIOUS LIQUIDS
ALTERNATE CONNECTION ELECTRICAL CONDUIT (ANALYZER → VALVE)
CHIPS AND PULP
BLACK LIQUOR
OXY LIQUOR
LIQUORS WHICH SUPPLY HYDROXIDE
LIQUOR VAPOUR CONDENSATE TO PULP WASHING
WASHING LIQUIDS
OXY PULP
COOKING LIQUOR
WHITE LIQUOR

METHOD FOR CONTINUOUS ALKALINE DELIGNIFICATION OF LIGNOCELLULOSE MATERIAL IN TWO OR MORE STEPS, THE FINAL OF WHICH WITH OXYGEN

The Swedish patent application No. 9915/69 (Lay-open print 369611) "Method for collecting and destroying or recycling of odorous sulphur compounds in the process of continuous digestion of kraft pulp" deals with a system for connection between digestion with recovery of black liquor (Brown Stock Washing) and a first bleaching step. This connection facilitates the utilization of bleach plant effluent in the brown stock washing for optimal recovery of the digesting and bleaching chemicals. These chemicals comprise alkaline and oxidizing compounds. Most commonly bleaching agents used form sodium chloride in the regeneration process, from which, however, chlorine and chlorine dioxide may be regenerated. But eventually at least the first bleaching step will advantageously be carried out with oxygen, preferably together with alkaline sodium compounds.

The lignocellulose-bearing material used for oxygen delignification comprises various fiber raw materials which henceforth will be designated chips and pulped chips which leave the digestion step in the form of brown stock. Oxygen is used for bleaching delignification of brown stock in a vessel designated oxy-tower where the oxy-step is carried out. Oxy-pulp and a bleaching effluent designated oxy-liquor are obtained from the oxy-step.

The present invention is related to combining continuous digestion and brown stock washing with alkaline oxygen delignification in a closed system in such a way that the oxy-liquor can be optimally utilized in the brown stock washing system. Such a system is described in my U.S. Pat. No. 3,830,688. According to the invention the oxy-liquor is to be recovered in such a way that when it, wholly or partially, is passed through the continuous digester it will cause the least possible dilution of the digesting chemicals and the black liquor. Hereby the formation of black liquor vapour condensate and recirculation of this foul condensate through the process from the joint evaporation of the black liquor and the oxy-liquor is limited. Any addition of water for the washing operations is thereby restricted so as to in part reduce the formation of black liquor vapour condensate and in part create a margin also for recirculation of foul condensate fractions which are otherwise more difficult to reuse because of their obnoxious character.

According to the invention the alkaline delignification takes place continuously in two or more steps, the last one being an oxy-step. The oxy-step can optionally be the first in a sequence of steps using oxygen or oxygen compounds. After the oxy-step the brightened pulp can be further bleached in successive bleaching steps appropriate for the aimed brightness. These successive steps are charged with one or more chlorine compounds such as chlorine, chlorine dioxide, chlorine monoxide or mixtures thereof. Interjacent alkaline extraction steps are applied between the bleaching steps. Oxygen compounds such as peroxides and ozone are used or have been proposed as being included in bleaching sequences after the oxy-step. A second step with oxygen or oxygen compounds may also be applied after any of the chlorine and chlorine dioxide steps. Depending on the actual chemical regeneration process, operating conditions, recovery of oxy-liquor and other bleaching effluents in a closed system can be accomplished through some of the following choices:

(a) regeneration of bleach plant alkali solely from oxy-liquor, (b) regeneration of bleach plant alkali from both oxy-liquor and subsequent bleaching effluent, preferably effluents with small content of chloride forming substance, (c) regeneration of active chlorine and optionally caustic soda from the bleaching spent liquors, whereby a fresh supply of oxidant as oxygen to the oxy-step maintains a necessary balance between the other delignification chemicals regenerated by various means.

It is of fundamental importance for various combinations of the alkaline delignification steps that the brown stock is discharged by means of a liquor which contains a small amount of oxygen consuming substances, but, advantageously, residues of NaOH from the digestion. This NaOH is utilized in the oxy-step for reaction of the brown stock with $O_2$.

The oxygen consuming compounds are primarily sulphur compounds ($S^{2-}$, $SH^-$, $S_2O_3^{\ 2-}$, polysulphides, etc.), organic sulphide sulphur compounds such as lignin compounds, in either the brown stock or dissolved in addition to the solids of lignin and cellulose components which NaOH has released from the chips. Volatile oxygen consuming substances other than sulphur compounds e.g. methanol, can be kept in the process by liquor vapour condensate recirculated to the oxy-liquor and passing through the digester. The possibility of reutilizing vapour condensate and thereby obtained bleaching effluents — and bleaching effluents in general — is increased if the major part of the delignification in the digester according to the invention is followed by a separation of oxygen consuming dissolved substance from the pulp. This implies that the dilution of the mixture of oxy-liquor/terminal black liquor which is conveyed to the evaporation plant is restricted to such a degree that the possibility is created for full or almost full utilization of the liquor vapor condensate in the process, for example for washings between the bleaching steps.

According to the invention oxy-liquor which was used in a pulp washing step, preferably in a brown stock washing separated from the digester, is utilized for displacing black liquor through the material column in the digester and in such a way that NaOH or a liquor containing NaOH, as well as ordinary white liquor, is successively injected to the oxy-liquor emerging through the washing and digesting zones of the digester. During this period the cooking liquor thus formed passes an intermediate zone of the column containing mixed black liquor and oxy-liquor. The resulting liquor mixture which is called terminal black liquor is led off from the chip zone of the column in the digester to the black liquor evaporation plant. The oxy-liquor is successively converted, together with white liquor, by the pulp and the chips to black liquor. The withdrawal of terminal black liquor from the digester takes place in such a way that the hydroxide content of the black liquor is wholly or substantially consumed by the chips, preferably steamed chips, entering the digester. An amount of white liquor may be added to the chips that pass through the digester feeder. Thus, hydroxide is supplied to essentially two digester zones and then consumed for alkaline delignification of the chips prior to drawing off the terminal black liquor from the digester ("Digester" here can also comprise several digester vessels connected with one another.)

A significant feature of the invention is that the white liquor is wholly or to a substantial degree introduced into that zone of the digester whose liquor circulation system otherwise mainly contains oxy-liquor. The joint digester liquor volume is then utilized for alkaline delignification of the chips to pulp and thereby produces substances which are extracted by the terminal black liquor. The oxy-liquor moves essentially counter-current to the column of pulp, i.e. the brown stock, and the chips respectively while by intervening cross-current forced circulation of the hydroxide-containing cooking liquor zones are maintained within which the favourable delignification conditions with regard to hydroxide concentrations are controlled according to the invention.

The hydroxide concentration can be controlled through direct physical measurement of the pH and/or conductivity of the circulating cooking liquor. However, automated chemical tritation analysis based on either said measurements or colorimetric measurements are already in practical use. These methods are valuable in dosing white liquor to the oxy-liquor in a zone of the digester. The digestion temperaure conditions are adapted to the applied hydroxide concentration in the cooking liquor and the residence times in the various zones.

Such control for regulated continuous pulp digestion has been developed on the basis of Vroom's H-factor which is based on reaction kinetics (according to Arrhenius) and expressng the relative delignification effect for a given reaction time and a given temperature level. An "M-factor" factor has also been recently developed elsewhere and it expresses the effect of the hydroxide concentration on the course of delignification for a given H-factor. The present invention is well suited to these control means because they facilitate the utilization of hydroxide even at relatively low concentrations thereof by utilizing hydroxide for neutralizing acid products released upon hydrolysis of the chips to the terminal black liquor. These reactions may proceed to expulsion of $H_2S$ and/or $CO_2$ from $Na_2S$ and $Na_2CO_3$; respectively. In this way subsequent consumption by the cellulose material of hydroxide ions originating from NaOH, e.g. injected to higher temperature zones, is reduced.

The terminal black liquor from the digester can be subjected to the conventional flash for recovery of heat for pre-steaming of the chips and for other purposes. It is, however, advantageous to introduce the black liquor under maintained digester pressure, as in my Swedish patent No. 227464 and in the Swedish patent application No. 9915/69 (Lay-open print No. 369,611), to the evaporation plant so that the heat of the vapour is utilized for multiple effect evaporation of the terminal black liquor.

Brown stock is transported from the digester by means of flushing with oxy-liquor which according to the invention will contain a small amount of oxygen consuming residues of black liquor substance. The ratio $$R = \text{oxygen consuming substance/sodium}$$

of the flushing liquor becomes less than 10–20% of the normally prevailing R-value for black liquor. The R-value thus depends on both the composition of the oxy-liquor and that of the accompanying sodium compounds which derive from the white liquor and the residues of primary black liquor accompanying the brown stock. Suitably 5–3 parts oxy-liquor per part brown stock are admitted to the brown stock washing. (Parts are calculated on weight and moisture-free pulp basis). The R-value of the oxy-liquor at the pulp (brown stock) discharge from the washing zone of the digester is then about 5% of the R-value of the black liquor. To reach this low R-value of the brown stock flushing liquor, i.e. mainly oxy-liquor, the oxy-liquor in the digester is advantageously furnished with white liquor which has no or a small amount of oxygen consuming sulphide compounds. As a replacement for sulphide in the white liquor, pulp-yield increasing sulphide compounds as known in the art may be applied in a separate digesting step for carbohydrate preserving pretreatment of the chips.

With effective brown stock washing equipment it has been found that it is possible to reduce the R-value of the waste liquor accompanying the brown stock to 2% of the R-value for conventional black liquor even at a dilution as low as 2, i.e. admitting only about 2 parts oxy-liquor per part brown stock. A remaining excess of oxy-liquor can be utilized for dissolving recovered alkali and preparing causticized white liquor. Such white liquor containing organic substance is actually more brownish than white and in another context, (the Silfate method, U.S. Pat. Nos. 2,738,270; 2,734,037; 3,248,169), it has been designated "brown liquor."

The attached drawing shows schematically a new system according to the invention. Through lines 1 and/or 2 is supplied fresh liquor to the alkaline delignification steps 3 and 4. In the digester 3 delignification is carried out with hydroxide and optionally sulphur compounds while in the oxy-tower 4 the hydroxide essentially only neutralizes and extracts alkaline soluble products from the reaction of brown stock 7 with oxygen 8. The reaction temperature and the pressure are attained through supply of steam 9. The suspension of oxy-pulp and oxy-liquor 10 is led to a pulp washer 11 from which recovered oxy-liquor is introduced into the washing zone 15 of the digester via a washing filter 13 which is alternatively equipped with a press for brown stock in the line 14. The various digester zones 15, **3*a* and 3*b* have circulation systems 15*b*, 3*c* and 18*b*, respectively, which are connected to circulation strainers fitted along the walls of the digester vessel. Similar means of liquor flow-through under liquid balance in the liquor system of the digester are applied, as those from known continuous counter-current digestion (my Swedish Pat. No. 227,464). The oxy-liquor displaces the cooking liquor and black liquor residues included therein from the brown stock in the washing zone 15 up through the digesting zone 3*a*. In that zone the hydroxide concentration of the oxy-liquor is increased by supplying white liquor through the line 5. Control of the hydroxide concentration is accomplished by regulating the white liquor flow through the control valve 16 which is governed by the cooking liquor analyzer 17. The black liquor components released in the digesting zone 3*a*, which zone contains also delignification products from the oxy-step 4, are drawn off as terminal black liquor at 3*b*. This terminal black liquor is conveyed either directly through line 18 to a hydroxide regeneration plant 30 or indirectly there via a step not shown for reaction with the chips which are supplied to the digester at 19. An arrangement for recovering flash-vapour by flash-tank ordinarily used for continuous digestion, is shown at 18***c*.

A portion of the white liquor 5, for example 20%, through line 5*b*, can be pre-reacted with the chips in a pre-steaming vessel 20 for steaming, alternatively with a portion of black liquor from circulation pipe 18*b*. The charge of all delignification hydroxide can be split so that one part, suitably 10–30% of the hydroxide, is added to the brown stock via the line 6 and the remainder through the line 5 to the digester zone 3*a* and alternatively to the steaming vessel 20. The delignification reactions consume hydroxide corresponding to about 10–20% NaOH based on moisture-free chips, depending on the amount of lignin left to the subsequent oxygen delignification. (If soda and other weak alkalis can be utilized for pre-neutralisation of acid components in the chips, the lower hydroxide consumption of about 10% NaOH is achieved). Of the hydroxide, which is consumed in the digesting zone 3*a*, the oxy-liquor contributes almost 5% and the demand for white liquor can be reduced by 10% as calculated on normal demand by means of reactions between alkali salts of weak acids in the spent liquors and the ligno-cellulose components in the chips. Because the oxy-liquor simultaneously displaces black liquor counter-current to the descending column of chips and pulp, the total consumption of hydroxide is reduced by about 25% based on the amount of hydroxide conventionally added for digestion for the same degree of delignification. A similar saving of hydroxide cannot be achieved in the previously known processes wherein the black liquor is conveyed concurrent to the column to the washing zone, from whence ordinary black liquor diluted with oxy-liquor is drawn off prior to the digesting zone. It is thus important that white liquor be supplied directly to the oxy-liquor containing cooking liquor in such a way that the combined hydroxide consumption, supplied via the liquor lines 6 and 5, can be regulated to a minimum in relation to the degree of delignification, cellulose quality and the ultimate yield of oxy-pulp and bleached pulp respectively. This is aided by control of the hydroxide concentration through the measuring devices 17 and 10*b*.

In some alkaline pulping processes same caustic soda liquor can be used in steps 3 and 4 from the lines 1 and 2. In other instances purified soda liquor is causticized for the oxy-step and sometimes for digestion also (Swedish patent application No. 9674/69 (Lay-open print 360129)). It has long been established that sulphide in white liquor for bleaching should be oxidized. (Mannbro, N., Svensk Papperstidning, 1963, p. 34).

For oxy-pulp washing a washing liquid of water or, alternatively, re-used washing waters such as a weak liquor or liquor vapour condensate of suitable purity are added to the continuous washer 11 (diffuser). A fraction of the washing liquid which is introduced via 22 accompanies the oxy-pulp to an optional subsequent bleaching step with, for example, chlorine compounds, while the remainder of the washing liquid 27 is mixed with and dilutes the oxy-liquor recovered through the line 12 and which finally contributes to the solids content of the terminal black liquor recovered at 18 from the digester 3. This enhances the importance for the alkali and water balance of the system of being able, by means of the joint flow of oxy- and white liquors, to effectively displace oxygen consuming (reducing) digestion products, i.e. black liquor substances in the washing zone 15 in the digester 3 and of exhausting the hydroxide of the joint flow from the delignification zone 3*a* through the column in zone 3*b*.

A supplementary method for utilizing the hydroxide content of the oxy-liquor in the column is to divert a part of the oxy-liquor at 23 to the white liquor preparation plant where it is used for dissolving of regenerated soda or soda smelt and for causticizing this soda emanating from oxy-liquor to hydroxide. Brown liquor thus obtained is transferred via the line 1 and 5 to the digester 3. Separately causticized liquor through line 2 and 6 may be required for the oxy-step unless the brown liquor is considered sufficiently free from oxygen consuming sulphur compounds.

On the attached drawing at 24 has been indicated an alternative separation of knots and other coarser material of the brown stock which is disintegrated 24*b* and returned to the line 7 so as not to cause interruptions in the operation of the filter and press arrangement 13. The screening rejects can when adaptable be diverted to be externally processed, with or without extracting the digester liquor residues, into board or paper. For a non-integrated pulp mill the screening is advantageously placed between the oxy-step 4 and the washing step 11 and the screen reject can wholly or partially after disintegration be returned to the oxy-step 4 with no dilution if it is flushed with oxy-liquor which is discharged by filter 13. (This alternaive has not been shown on the drawing).

To illustrate the inter-relation between dilution of the oxy-liquor and black liquor and the internal water cycle of the process a liquor evaporation plant 25 is shown which delivers concentrated black liquor at 26 whose chemical content of alkali, i.a., is regenerated in the regeneration plant 30. Evaporation plant condensate is used in chemical regeneration plants, which condensate it otherwise utilized via the line 27 for washing 22 of oxy-pulp and optionally for its further bleaching 28 from which, depending to which extent chloride forming bleaching agents can be either treated or avoided, the bleaching effluent 29 can be recycled to the process.

Brown stock washing in the system 15-13 can be designed for various applications. A part of the displacement in 15 can be replaced by a separate washing vessel or diffuser. Generally speaking all systems known in the art comprising a sequence of washing filters and/or presses may be used for washing brown stock, oxy-pulp and pulp from subsequent bleaching steps.

Digester vessels of types other than those shown here may be used for the delignification steps. Thus various digesters of the vertical type such as KAMYR, ESCO, IMPCO, ESCHER-WYSS and DEFIBRATOR are used in the pulp industry. Horisontal (Pandia) or inclined tubular digesters (M&D) having screw and scraper inserts, respectively, are used for both conventional chemical pulps as well as semi-chemical pulps which all can be further delignified with oxygen according to the invention. Inclined tubular digesters having liquid drainer on the discharge end of the lower tubular half are well suited for the invention. In this way the oxy-step is also carried out in a lower digester tube in a system of stacked inclined digester tubes. One such digester is the M&D digester which is described in the literature for alkaline pulping in several steps. One application is the Alkafide type of digestion in a tube, which may be modified for addition of sulphide-free alkali in the next tube and then the oxygen-step is carried out in the final tube. To the liquor drainage and/or displacement zones in the discharge ends of the tubular digester, presses and/or washing plants may be attached to serve in the passages between the steps. In this way light and strong pulp, e.g. for linerboard can be produced by alkaline sulphite digestion and oxygen steps.

The present invention is not suitable for batch digestion. The reason is that in a batch system it is not possible to effect liquor displacement with a joint white liquor and oxy-liquor volume successively through the column of chips and pulp which descends in the digester. Accordingly for batch digestion external liquor accumulators are required to achieve a similar effect in the oxy-step. That type of batch digestion process is described in my U.S. patent application Ser. No. 523,873, filed Nov. 14, 1974 now abandoned.

According to the present invention alkaline digestion relates not only to common alkaline digestion in accordance, for example, with the sulphate method at pH 13–11, but also to the use of hydroxide ion concentrations corresponding to a pH as low as 7.5 for NSSC digestion.

What I claim is:

1. In a method for the continuous pulping of a moving column or bed of lignocellulose material with alkaline delignification liquors containing hydroxide releasing sodium compounds, said pulping being carried out in at least two steps of which the final step is an oxygen-consuming delignification step wherein brown stock is delignified to oxy-pulp by means of oxygen-consuming reactions with the formation of oxy-liquor, while the brown stock is obtained from a continuous digester using cooking liquor prepared from white liquor and which cooking liquor contains dissolved oxygen-consuming substance deriving from the lignocellulose material and from reaction compounds thereof with the cooking liquor which substance in the form of black liquor constituents are displaced from the digester by means of recovered oxy-liquor; the improvement comprising (A) adjusting the concentration ratio $R$ = oxygen consuming substance/sodium for the digester liquors to make the R-value of terminal black liquor drawn off from the digester greater than the R-value of the cooking liquor surrounding that part of the material which is delignified to brown stock, by admixing with the cooking liquor in the digester or the digestion zone in a multi-zone digester (a) oxy-liquor and (b) the major portion of white liquor totally supplied for the alkaline delignification, said mixed cooking liquor being led wholly or partly countercurrent to the material, (B) adjusting the hydroxide concentration of the cooking liquor and the consumption of this hydroxide by adding white liquor hydroxide to the cooking liquor so that of the sum of added hydroxide and hydroxide releasable from the recovered oxy-liquor (a) one fraction of hydroxide is utilized for extracting oxygen consuming substance from the introduced lignocellulose material whereby terminal black liquor is formed and (b) the other fraction of hydroxide in the cooking liquor is carried by the brown stock to its discharge from the digester and is largely recovered in the cooking liquor while (c) the brown stock and a portion of the recovered oxy-liquor are conveyed to said final oxygen-consuming delignification step, which is accordingly supplied with hydroxide from recirculated oxy-liquor and with hydroxide from the remainder of the cooking liquor accompanying the brown stock prior to any addition of hydroxide required for the oxygen-consuming delignification in this final step.

2. The method of claim 1, in which a portion of the oxy-liquor used for brown stock displacement washing is drawn off directly to a hydroxide regeneration plant.

3. The method of claim 1, in which a portion of oxy-liquor is used for dissolving and/or preparing sodium compounds in the regeneration of hydroxide in brown liquor after which the portions of oxy-liquor are reunited in the digester.

4. The method of claim 1, in which said continuous pulping is performed according to the sulphate method.

* * * * *